US007430947B2

(12) United States Patent
Julian et al.

(10) Patent No.: US 7,430,947 B2
(45) Date of Patent: Oct. 7, 2008

(54) PROPORTIONAL LENGTH FOOD SLICING SYSTEM

(75) Inventors: John C. Julian, Richland, WA (US); Gary R. Brockman, Kennewick, WA (US); Trent R. Wetherbee, Kennewick, WA (US)

(73) Assignee: ConAgra Foods Lamb Weston, Inc., Kennewick, WA (US)

( * ) Notice: Subject to any disclaimer, the term of this patent is extended or adjusted under 35 U.S.C. 154(b) by 589 days.

(21) Appl. No.: 10/870,701

(22) Filed: Jun. 16, 2004

(65) Prior Publication Data

US 2005/0279228 A1 Dec. 22, 2005

(51) Int. Cl.
*B26D 5/20* (2006.01)

(52) U.S. Cl. ..... 83/207; 83/221; 83/391; 83/932

(58) Field of Classification Search ..... 83/207–214, 83/268, 391, 396, 932, 394, 409, 419, 444, 83/490, 703, 221, 257, 262; 99/537
See application file for complete search history.

(56) References Cited

U.S. PATENT DOCUMENTS

| | | | | |
|---|---|---|---|---|
| 224,631 | A | | 2/1880 | Berzine |
| 993,173 | A | | 5/1911 | Karhu |
| 1,399,950 | A | | 12/1921 | Fish |
| 1,411,832 | A | | 4/1922 | Bentley |
| 1,628,779 | A | | 5/1927 | Israelson |
| 1,878,423 | A | | 9/1932 | Nowlin |
| 2,417,174 | A | | 3/1947 | Prenveille |
| 2,645,262 | A | | 7/1953 | Marasco |
| 2,852,053 | A | | 9/1958 | Berry et al. |
| 3,096,801 | A | | 7/1963 | Miles et al. |
| 3,116,772 | A | | 1/1964 | Lamb et al. |
| 3,291,176 | A | | 12/1966 | Peterson |
| 3,391,005 | A | | 7/1968 | Babigan |
| 3,530,915 | A | * | 9/1970 | Sadanobu ..... 83/490 |
| 3,667,522 | A | * | 6/1972 | Bingham ..... 83/391 |
| 3,685,560 | A | | 8/1972 | Siegmann |
| 3,783,727 | A | * | 1/1974 | Brignard et al. ..... 83/356.3 |
| 4,082,024 | A | | 4/1978 | Hodges et al. |
| 4,095,518 | A | | 6/1978 | Jones |

(Continued)

OTHER PUBLICATIONS

"NEW! Farmco Potato Halver," Key Technology Inc., www.key.net, 4 pp., Apr. 2004.

(Continued)

*Primary Examiner*—Stephen Choi
(74) *Attorney, Agent, or Firm*—Klarquist Sparkman LLP

(57) ABSTRACT

This invention includes a system for cutting food products, such as potatoes, into proportional length pieces. In a one embodiment, the system includes a cutting assembly, sensors upstream of the cutting assembly and a programmable logic controller. The cutting assembly preferably includes a housing defining a passageway, at least two separately actuatable stops extendable into the passageway to provide an abutment to hold the food product in place, and at least two separately actuatable blades for slicing the food product into pieces. The controller cooperates with the sensors to determine the length of each food product and, based on a length determinative algorithm, selectively actuate one of the stops and at least one of the blades to determine how many times the food product will be sliced and location of the cut(s) relative to the leading end of the food product.

7 Claims, 8 Drawing Sheets

U.S. PATENT DOCUMENTS

| | | | | | |
|---|---|---|---|---|---|
| 4,372,184 | A | | 2/1983 | Fisher et al. | |
| 4,960,025 | A | * | 10/1990 | Fitch | 83/703 |
| 5,343,790 | A | * | 9/1994 | Kuhrt | 83/444 |
| 5,458,055 | A | * | 10/1995 | Fitch, Jr. | 83/703 |

OTHER PUBLICATIONS

"Eddy. 'More than just another halver'," GME Inc., www.gme-intl.com/Eddy.htm , 1 page, Apr. 2004.

* cited by examiner

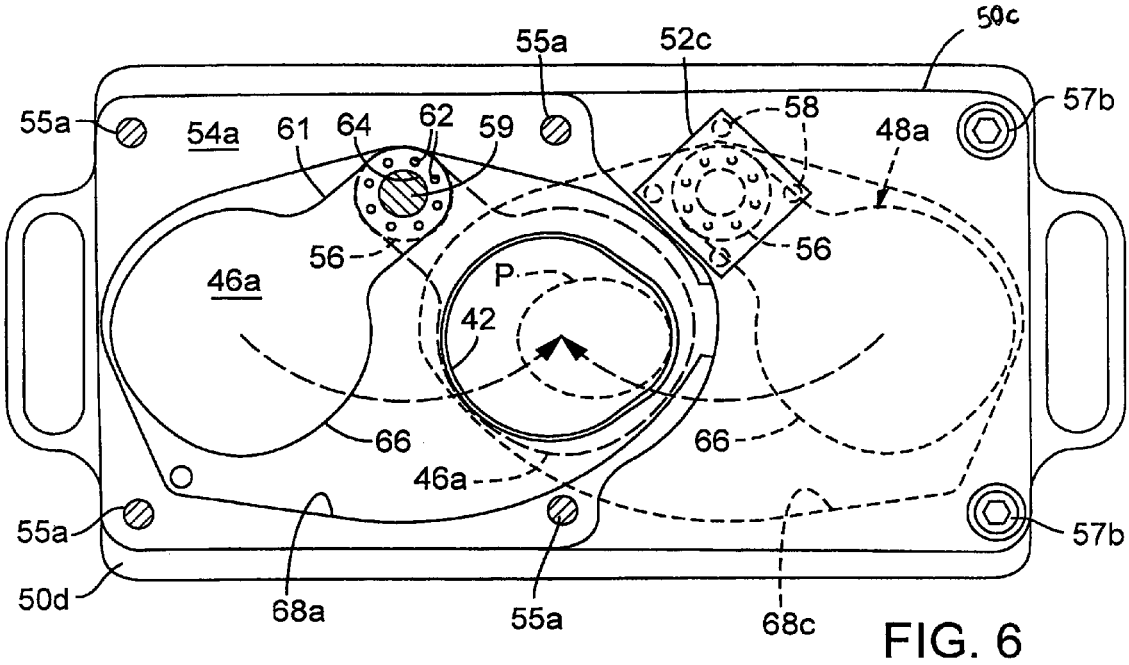
FIG. 6
FIG. 7
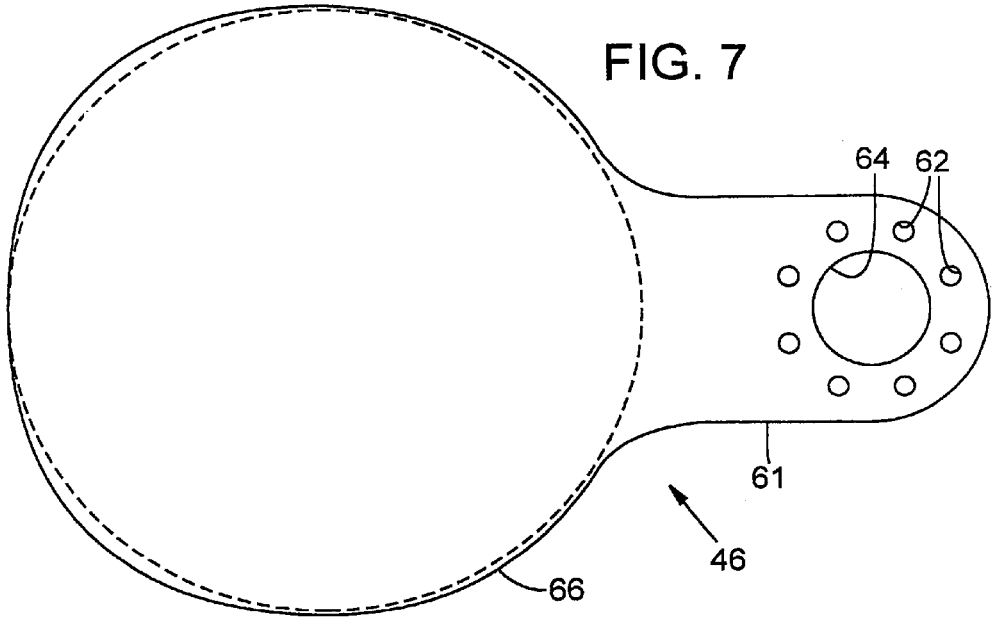

PROPORTIONAL LENGTH FOOD SLICING SYSTEM

This invention relates to a system for slicing potatoes and other food products, especially vegetables, into proportional length pieces.

BACKGROUND OF THE INVENTION

Commercial potato processors typically prepare frozen processed strips by washing and sometimes peeling whole potatoes, inspecting the whole potatoes to trim defects and sort them if necessary, cutting the whole potatoes into strips, and then subjecting the strips to additional processing and freezing steps. Institutional and business customers, such as fast food restaurants, who purchase the frozen potato strips from the potato processor typically prepare the strips by frying them in oil and serve them to customers as french fries. Fast food restaurants and other purveyors of french fries often require the packaged frozen potato strips to meet exacting length or "count" specifications which limit the number of "short" strips allowed per pound as well as the number of "long" strips allowed per pound. Short strips are strips shorter than a specified length, and long strips are strips longer than a specified length. Long strips are produced when unusually long potatoes (exceeding six or seven inches, for example) are sliced into strips by a strip cutter, such as a "water gun."

Fast food restaurants and many other french fry purveyors view long strips as undesirable because they adversely affect serving yield and do not fit well in disposable serving containers sized to hold strips of shorter length. Commercial potato processors also view long strips as undesirable because they are more prone to break during processing and shipping and may be crushed during packing if the length exceeds the headspace of the packing enclosure. Traditionally, commercial processors have controlled the number of long potatoes in the conveyor line by having inspectors manually pull long potatoes at the trimming station, cut the potatoes into halves or thirds and then return the cut pieces to the moving conveyor line.

More recently, two commercial systems have been introduced to provide a more automated solution to the problems associated with long potatoes. The Farmco Division of Key Technology offers a commercial cutting system in which whole potatoes are transferred to one of a series of flights mounted on an endless, steeply inclined (almost upright) conveyor. The conveyor is tilted away from vertical to keep the potatoes from rolling off the conveyor belt. Each flight conveys a single potato upwardly toward a rotating but otherwise fixed cutting blade. The blade has a horizontal axis of rotation and rotates in a vertical plane aligned with the center of the conveyor bolt. Spring-biased fingers engage opposite ends of the potato as it approaches the blade to keep its midsection generally aligned with the cutting edge of the blade. The flight conveys the potato upwardly into cutting engagement with the blade, which cuts the potato in half transversely. Each flight is split into two sections, with a gap therebetween, to permit the sections to pass on either side of the blade as the potato is sliced.

GME, Inc. offers an automated commercial potato cutting system having a generally horizontal "U" shaped trough with a longitudinal slot in the bottom. The slot allows longitudinally spaced paddles in the trough to be mounted to an endless conveyor chain underlying the trough. The paddles advance the potatoes in the trough, one by one, to a cutting station. At the cutting station, a pivotally mounted swing blade is actuated to slice the advancing potato in half crosswise as the blade swings forward across the path of the potato or, alternatively, into thirds as the blade slices the advancing potato on its forward swing and then again on its backswing. A sensor upstream of the cutting station apparently senses the length of the potato and transmits the length data to a controller which determines when to actuate the blade to intersect the path of the moving potato and whether to actuate the blade to cut the potato roughly into halves with one cut or into thirds with two cuts.

In the commercial potato industry there remains a need for a durable commercial proportional length cutting system having a simple construction, more precise cutting action and capacity to flexibly cut potatoes or the like into a broad range of proportional lengths, and yet is able to operate efficiently, reliably and consistently in a continuous, demanding high production commercial operation.

BRIEF SUMMARY OF THE INVENTION

This invention includes a system for cutting food products including potatoes into proportional length pieces. In one embodiment, the system includes a cutting assembly having a housing which defines a passageway, at least one stop movable between a retracted position on one side of the passageway to an extended position obstructing the passageway, and at least one blade movable between a retracted position on one side of the passageway to an extended position spanning the passageway. An actuating device actuates the stop to provide an abutment in the passageway against which the food product rests, and actuates the blade to make a crosswise cut through the stationary food product. The cutting assembly preferably is oriented to give the passageway a downwardly inclined slope to allow the food product to move downwardly, with the assistance of gravity, to the cutting zone.

In a preferred embodiment, the cutting assembly includes at least two separately actuatable stops and two separately actuatable blades spaced longitudinally from one another, and a control system for controlling the actuation of the stops and blades. In a typical cutting cycle, the control system actuates one of the stops and one or more of the blades to cut the food product into two pieces or, alternatively, more than two pieces. The control system cooperates with sensors located upstream of the cutting assembly, which sense the passage of the food product and generate data from which the control system automatically determines the length of the food product. For each food product, the control system applies a length based algorithm to select a particular stop/blade combination and then signals the actuating device to actuate the selected stop and blade(s). Each stop and blade retracts automatically after the cutting step is complete, thereby releasing the cut pieces to enter an exit tube and move away from the cutting station. The control system is programmed not to actuate a stop or blade if a potato passes the sensors prematurely, during the cutting cycle of the preceding potato, and instead allow the potato to pass straight through the cutting assembly without delay.

The control system also may operate simultaneously and independently plural sets of sensors and cutting assemblies, each defining a separate cutting lane, to increase throughput. Other features and aspects of the present invention are described with reference to exemplary embodiments in the following detailed description.

BRIEF DESCRIPTION OF THE DRAWINGS

FIG. 6 is horizontal cross section view of the cutting assembly taken along line 6-6 of FIG. 5A.

FIG. 7 is a top plan view of one of the blades/stops of the cutting assembly.

DETAILED DESCRIPTION OF THE PREFERRED EMBODIMENTS

A proportional length cutting system in accordance with one exemplary embodiment of the present invention is shown in FIGS. 1-9. While the present invention is well-suited for cutting potatoes or other tubers such as sweet potatoes into proportional length pieces (halves, thirds, fourths, etc.), the invention may be used in other food processing applications to cut, for example, other fruits and vegetables such as carrots and cucumbers into a plurality of pieces. The invention is particularly well-suited for making one or more transverse or crosswise cuts in elongated fruits and vegetables having a well-defined longitudinal axis. For exemplary purposes, however, the present invention is described in the context of a system for cutting potatoes into proportional length pieces.

It will be apparent from the following description that the present invention is not limited to slicing potatoes (or other food products) into pieces of precisely the same length and, in fact, with most potatoes the cut pieces will not have precisely the same length. The term "proportional length" is used to distinguish the present invention from cutting systems which operate to cut food products, such as potatoes, into many elongated strips, as well as systems which operate to dice or otherwise cut food products into numerous relatively small cubes or pieces.

While the present invention is described in the context of a system having multiple lanes and cutting assemblies for simultaneously cutting more than one potato, it will be appreciated that the present invention can be constructed and operated as a single lane system with only one cutting assembly. Except as otherwise noted, the construction and operation of the components in each cutting lane are identical.

Figure 1:
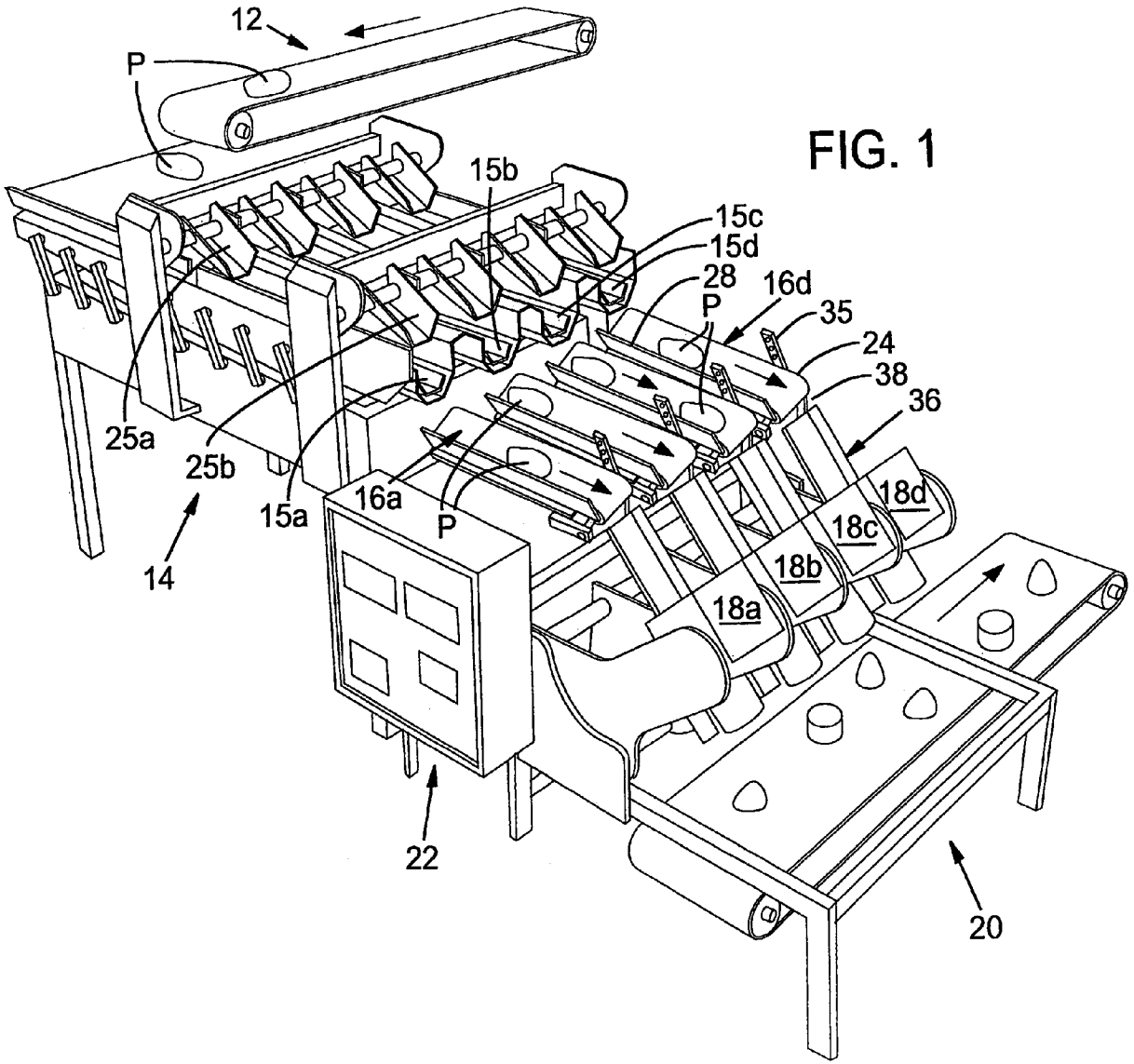
FIG. 1 is a perspective view of a proportional length cutting system in accordance with one embodiment of the present invention.

As shown in FIG. 1, the present invention preferably includes a conventional feed conveyor 12, conventional shaker conveyor 14 having cutting lanes 15*a, b, c, d*, slant conveyor system having slant conveyors 16*a, b, c, d* (FIG. 9), cutting system having more than one cutting assembly 18, outfeed conveyor 20 and control system 22. In a typical commercial "french fry" production line, whole potatoes exceeding a defined maximum length specification (6 or 7 inches, for example) are diverted, manually or otherwise, to the feed conveyor 12. The feed conveyor 12 conveys the "long" potatoes to the shaker conveyor 14 which singulates the potatoes by delivering them to one of the lanes 15*a, b, c, d*. The shaker conveyor oscillates each lane to convey the singulated potatoes to one of the slant conveyors 16*a, b, c, d*, each of which in turn conveys the potatoes one by one to one of the cutting assemblies 18*a, b, c, d*. Each shaker conveyor is provided with independently operable entry and exit gates 25*a*, 25*b* to control the flow of potatoes into and out of each lane 15*a, b, c, d*. Each slant conveyor delivers the whole potatoes, one at a time, to its respective cutting assembly 18 where the potatoes are cut into at least two pieces. The outfeed conveyor 20 receives the cut pieces from each cutting assembly and delivers them to the main production line where they merge with smaller whole potatoes and eventually are cut into strips.

Figure 2:
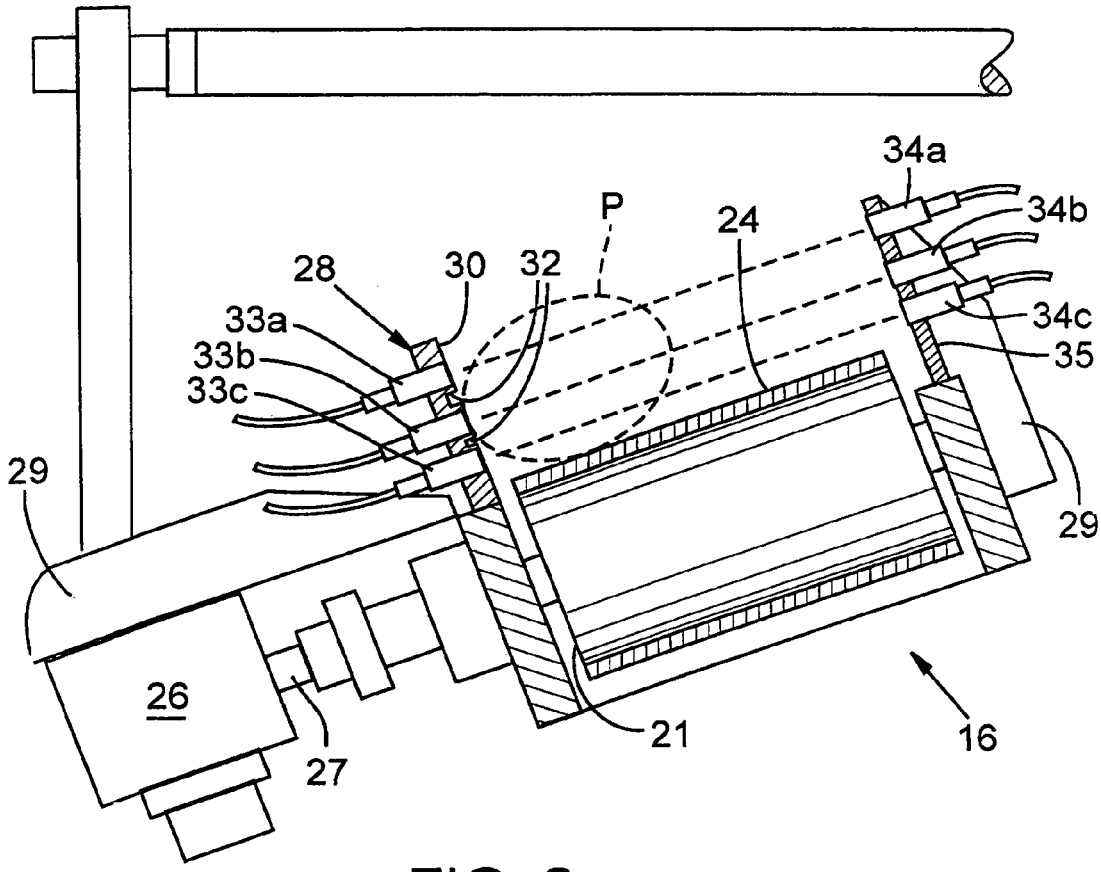
FIG. 2 is an enlarged vertical cross section view of one of the slant conveyors shown in FIG. 1, taken along a vertical plane passing through a sensor supporting rail and sensor supporting bracket.
Figure 9:
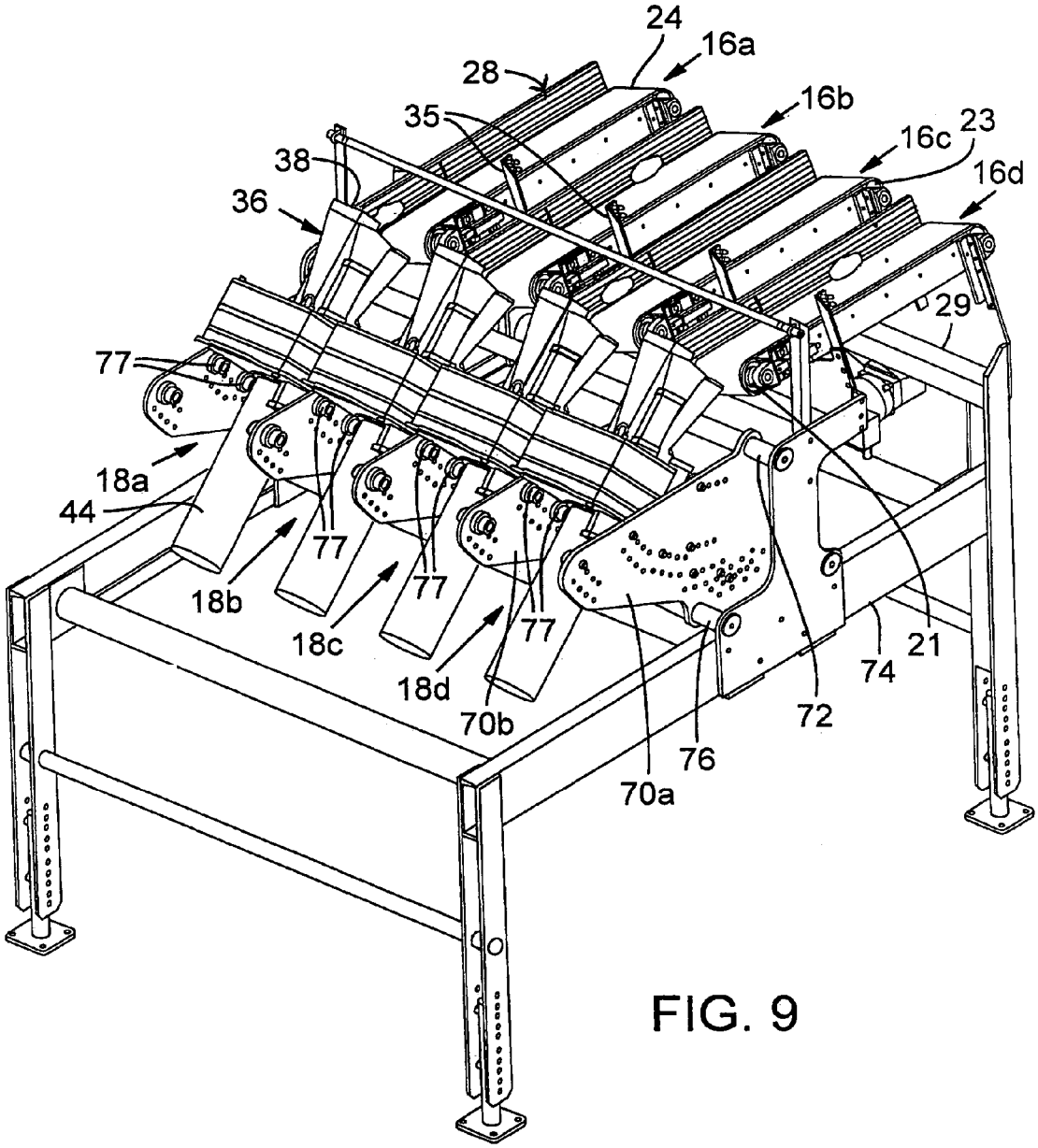
FIG. 9 is an enlarged perspective view of a portion of the system of FIG. 1, showing an array of slant conveyors and cutting assemblies.

Referring to FIGS. 2 and 9, one of the slant conveyors 16 will now be described. The slant conveyor serves to keep the potatoes singulated, provide adequate spacing between the singulated potatoes for cutting purposes and deliver the potatoes one at a time to the downstream cutting assembly 18. The slant conveyor has a flat endless conveyor belt 24 supported by a head roll 21 and tail roll 23 (FIG. 9) in a conventional manner, and is independently driven by a hydraulic motor 26 coupled to a drive shaft 27 in a conventional manner. Each slant conveyor may be operated independently of the others. The conveyor belt 24 is tilted or canted on its side at an angle of about 15 to 25 degrees, preferably about 20 degrees, relative to a horizontal plane, and is supported by a frame 29 (FIG. 2). The slant conveyor includes a side rail 28 (FIG. 9) that extends the full length of the conveyor belt 24. The side rail 28 is adjacent and in close proximity to the lower edge of the conveyor belt to retain the potatoes on the slant conveyor, as shown best in FIG. 2.

With the belt tilted to one side, each potato conveyed thereon will roll to the lower side of the belt and ride against the side rail 28 as it moves downstream toward the cutting assembly. The natural tendency of the potato is to ride against the side rail with its longitudinal axis aligned with the direction of travel of the belt. Thus, the slant conveyor helps to position the food product in the desired orientation for cutting downstream. An inner surface 30 of the side rail, which faces the conveyor belt, preferably is provided with spaced apart, parallel grooves 32 (FIG. 2) extending the full length of the side rail to reduce the amount of surface area contact between the potato and side rail. The grooves not only reduce the amount of friction generated by surface contact but serve to guide the potato and reduce the tendency of the potato's front end to ride up on the side rail.

In operation, the conveyor belt 24 is driven at a speed greater than the effective conveyor speed of the shaker conveyor, so as to increase the spacing of the potatoes in each lane (relative to the shaker conveyor) and give the downstream cutting assembly sufficient time to perform the cutting operation on each potato.

As shown in FIG. 2, near the downstream end of each slant conveyor 16, sensors are provided to sense the passage of each potato and generate relevant data from which the length of each potato may be determined. This data is communicated to the control system 22 for use in the cutting operation. A wide variety of optical, motion, radiofrequency, photoelectric or other sensors capable of generating data from which the potato's length may be determined may be used. In the exemplary embodiment shown in FIG. 2, a series of aligned transmitting photoelectric sensors 33*a, b, c* are mounted flush in the side rail 28, while a corresponding series of receiving photoelectric sensors 34*a, b, c* are mounted on a bracket 35 in a line-of-sight manner with corresponding sensors 33*a, b, c*. Each receiving sensor 34*a, b, c*, preferably is provided with an aperture (not shown), such as a disk with a central opening, to focus or at least reduce the light energy received by the receiving sensor. One exemplary photoelectric sensor system includes the Model SMT6000TS5 transmitting sensors and Model SMR6406TS5 receiving sensors manufactured by Telco Sensors, Inc. The sensors 33, 34 together operate to sense the time elapsed between the passage of the leading and trailing edges of the potato. In principle, the passing potato blocks the line of sight of at least one pair of aligned transmitting and receiving sensors until its trailing end moves beyond the sensors. A multiplexed amplifier (not shown), such as the Model MPA41B701 made by Telco, Inc., is electrically coupled to the sensors to, among other things, independently operate each set of transmitting and receiving sensors on separate channels and prevent optical crosstalk. The timing data generated by the sensors is communicated to the control system 22, as explained in greater detail below.

Figure 3:
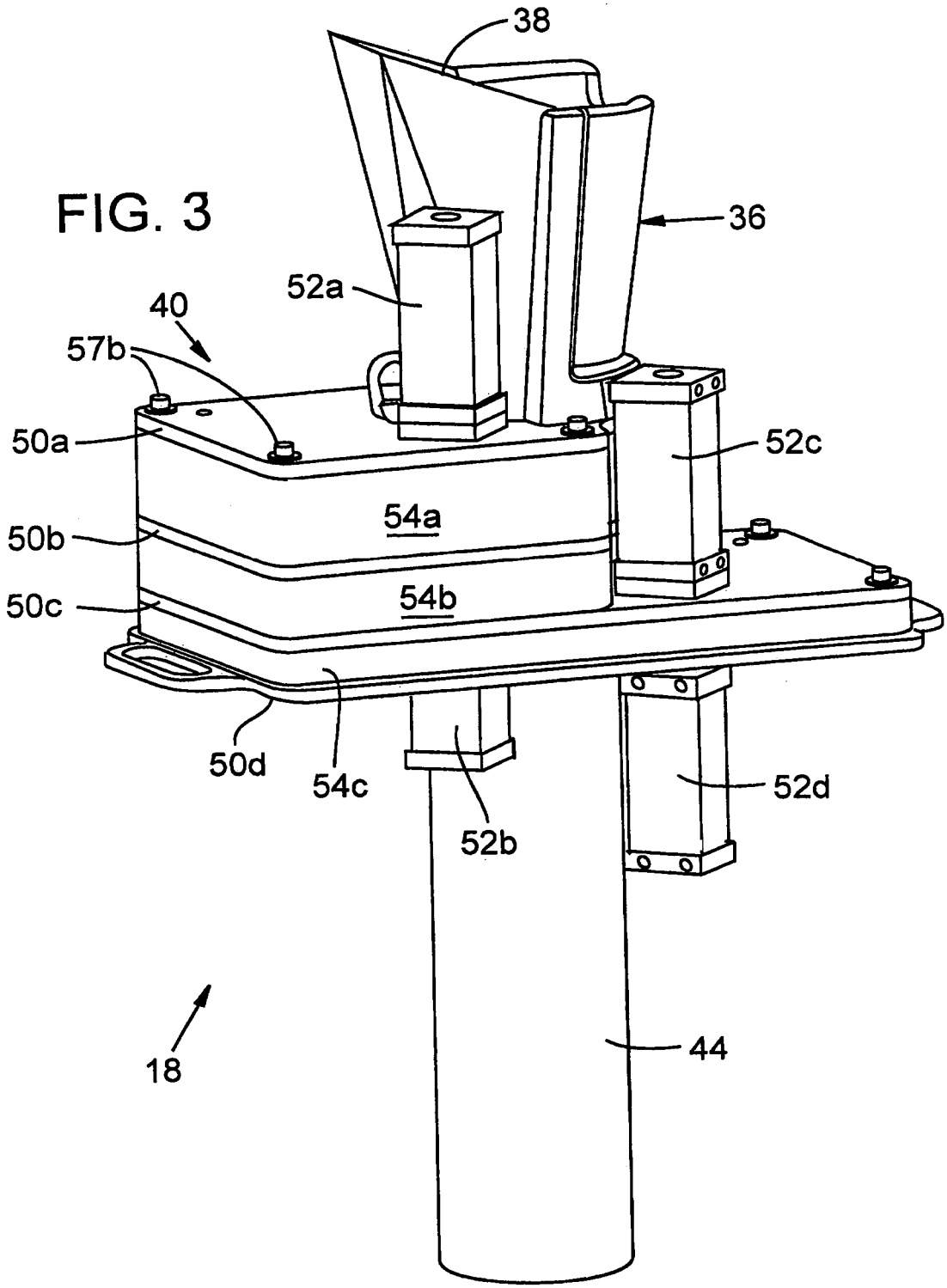
FIG. 3 is an enlarged perspective view of one of the cutting assemblies shown in FIG. 1.
Figure 4:
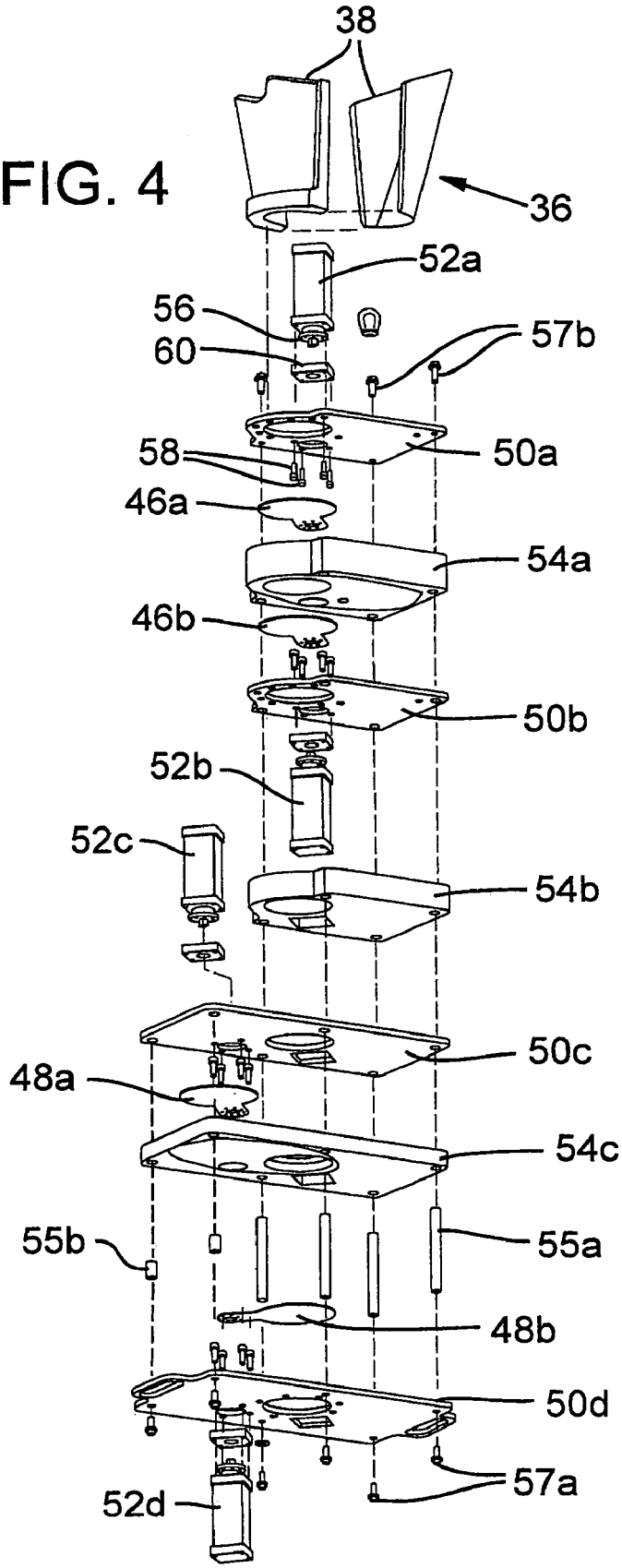
FIG. 4 is an exploded perspective view of the cutting assembly of FIG. 3.

After the potato passes the sensors, the slant conveyor delivers the food product to the cutting assembly 18, shown in greater detail in FIGS. 3-5. The cutting assembly 18 preferably includes an infeed tube 36 having an enlarged mouth 38, housing 40 that at least partially defines an internal passageway 42 (FIG. 5), and exit tube 44. The housing preferably supports a plurality of blades 46*a*, 46*b* and a plurality of floors or stops 48*a*, 48*b*, each of which is movable between a retracted position located away from the passageway (to one side) and an extended position in which the blade/stop extends transversely or substantially transversely across the passageway 42. Each blade/stop preferably is actuated by its own pneumatic actuator 52*a*, 52*b*, 52*c*, or 52*d*.

In the exemplary embodiment shown, the housing 40 preferably includes a series of parallel, longitudinally spaced support plates 50*a*, 50*b*, 50*c*, or 50*d*, each of which supports one of the blades/stops for pivotal movement and mounts the pneumatic actuator to which the blade/stop is attached. The housing also includes spacer members 54*a*, 54*b*, and 54*c*, each of which is disposed between an adjacent pair of support plates to create a desired spacing therebetween. The relative spacing of the blades and stops may be easily adjusted simply by replacing one or more existing spacers with substitute spacers having greater or lesser thickness. The support plates may be fabricated from metal such as stainless steel, and the spacer members from a plastic material such as ABS or Delrim® acetal homopolymer.

The support plates 50 and spacer members 54 preferably are sized and shaped to allow the support plates, spacer members, blades, stops and pneumatic actuators to be assembled together in a compact, tightly nested arrangement, as illustrated best by FIG. 5. More specifically, for example, spacer members 54*a*, 54*b* and plates 50*a*, 50*b* are contoured and shaped to provide clearance for pneumatic actuator 52*c*, while spacers 54*b*, 54*c* and support plates 50*c*, 50*d* have cutouts to permit pneumatic actuator 52*b* to extend internally into the housing to couple to blade 46*b*. The spacer members and support plates also have aligned cutouts to provide a smooth, substantially seamless inner wall for a portion of the passageway's length. The support plates and spacer members preferably are detachably fastened together by conventional threaded fasteners, such as stand-offs 55*a, b* (among others) and mating bolts 57*a, b* (among others), as shown in FIG. 4. In this way, the longitudinal spacing of the blades and stops relative to the passageway 42 can be easily adjusted by disassembling the cutting assembly and substituting spacer members having a different thickness, thereby changing the cut profile of the cut potato pieces.

By way of example, the construction and operation of the actuating device for actuating the blades and stops will now be described with reference to the actuator 52*a* and blade 46*a* detachably fastened thereto. One type of actuator that works well is a conventional rotary vane-type pneumatic actuator such as Model PV36-090BSE32-B, made by Parker Hannifin Corp., Richland, Mich. With reference to FIG. 4, the actuator includes a rotary shaft 59 (FIG. 6) to which a mounting collar 56 is fastened. The collar rotates with the shaft. A spacer 60 having a central opening large enough to permit the collar 56 and shaft to pass therethrough is mounted to the same end of the actuator as the collar/shaft by threaded fasteners 58. The threaded fasteners 58 also pass through openings in the support plate 50*a* to removably mount the spacer 60 and actuator to one side of the support plate 50*a*, such that the collar 56 sits within an opening in the support plate 50*a* and yet is free to rotate. The spacer 60 serves to position the collar within the support plate opening, such that the collar's end face is substantially flush with but raised slightly relative to a side of the support plate opposite the pneumatic actuator. The collar end face has threaded openings (not shown) used to mount the blade 46*a*. These openings match up with a corresponding set of openings 62 (FIG. 7) formed in the blade. Bolts inserted through the openings 62 fasten the blade against the collar end face. In this way, the blade 46*a* is spaced slightly from the adjacent support plate and is free to rotate or pivot freely with the mounting collar to which it is attached. The actuators are supplied with a source of pressurized air in a conventional manner.

Referring to FIGS. 6 and 7, each blade may have a ping pong paddle-like configuration, which includes a mounting extension 61 and a substantially circular cutting portion 66. The extension is provided with a relatively large opening 64 sized to receive the end of the rotary actuator shaft. The extension 61 also includes smaller openings 62 which are spaced equally around the opening 64 to permit the blade to be securely fastened against the rotary collar of the actuator. Though not critical, the dashed line in FIG. 7 illustrates that the cutting portion 66 is not exactly circular. It will be appreciated, however, that the blade can have a wide variety of shapes to perform its cutting function. Since the blade is mounted slightly above the surface of the adjacent support plate to provide clearance, the blade is free to rotate or pivot about the axis of rotation defined by the actuator shaft.

Unless otherwise indicated, the blades and stops have the same construction, are mounted and actuated in the same manner and are substantially identical in all respects.

As shown in FIGS. 3 and 5, each spacer member 54 is sandwiched between and mounted flush against a pair of adjacent support plates. However, to provide clearance for the blade or stop, spacer members 54*a* and 54*c* (which may be made of a hard plastic material such as ABS or other suitable material) are machined or formed to provide a recess or pocket 68*a*, 68*b*, 68*c*, or 68*d* (FIGS. 5 and 6) in those surfaces adjacent one of the stops/blades. Thus, the spacer 54*a* is provided with recesses 68*a*, 68*b* to receive blades 46*a*, 46*b*, respectively. Similarly, the spacer 54*c* is provided with recesses 68*c*, 68*d* to receive stops 48*a*, 48*b*, respectively. The size and shape of each recess is sufficient to allow the stop/blade to move freely from a fully retracted position in which the blade/stop is outside the passageway 42 to an extended position in which the blade/stop extends fully across the passageway and preferably slightly beyond. In this way, the blade/stop is free to retract and extend within its recess and yet is given some measure of support and guidance by the surrounding structure, as necessary. In other words, if the blade or stop is subjected to significant forces in the longitudinal direction, the surrounding structure acts as a stop to limit deflection of the blade/stop.

By way of example, FIG. 6 illustrates how the rotation of the collar 56 causes the attached blade 46*a* to pivot from its retracted position (shown in solid lines) in recess 68*a* to its extended position (shown in dashed lines) spanning the passageway 42. As the blade extends into the passageway, it slices the potato P. Similarly, the stop 48*a* is shown in dashed lines in its retracted position in recess 68*c*.

In a preferred embodiment, the blades are thinner than the stops to enable each blade to slice more easily through the potatoes and enable each stop to better withstand stress caused by potatoes impacting the stop. For example, each blade may have a thickness of 1/32 inch and each stop a thickness of 1/16 inch.

The operation of the cutting assembly will now be described. After whole potatoes are singulated into one of several lanes by the shaker conveyor, spaced at least a minimum distance from preceding and following potatoes by the slant conveyor, and profiled for length data by the sensors, each potato is deposited into the enlarged mouth 38 of the infeed tube 36. As best seen in FIGS. 1 and 9, the entire cutting assembly, including the infeed tube and passageway, is downwardly inclined relative to a horizontal plane at an angle preferably of about 40 to 50 degrees, and most preferably about 43 to 47 degrees. In this way, gravity is used to deliver each food product in a controlled manner to a cutting zone within the cutting assembly housing. The path of the potato's controlled "fall" toward the cutting station preferably is not so steep as to make the potato a freefalling object prone to losing contact with a bottom side of the passageway on which the potato slides. Nor is the path so shallow as to allow friction between the potato and passageway to slow the potato's downward descent to the extent that throughput is significantly reduced or the potato's smooth descent toward the cutting zone is disrupted. For example, unpeeled potatoes are more inclined to stick and benefit from a slightly increased angle of incline.

Notably, the entire passageway leading to the cutting zone, including the infeed tube, preferably has a pear- or egg-like cross section (see FIG. 6) such that the bottom side of the passageway has a smaller radius of curvature than the top side. In this way the passageway helps guide the potato and reduce any tendency of the potato to roll from side to side. The shape and orientation of the passageway also tends to maintain the longitudinal axis of the potato in alignment with the longitudinal axis of the passageway to facilitate cutting. With the potato so oriented, the blade(s) make a transverse or crosswise cut in the potato.

Figure 5A:
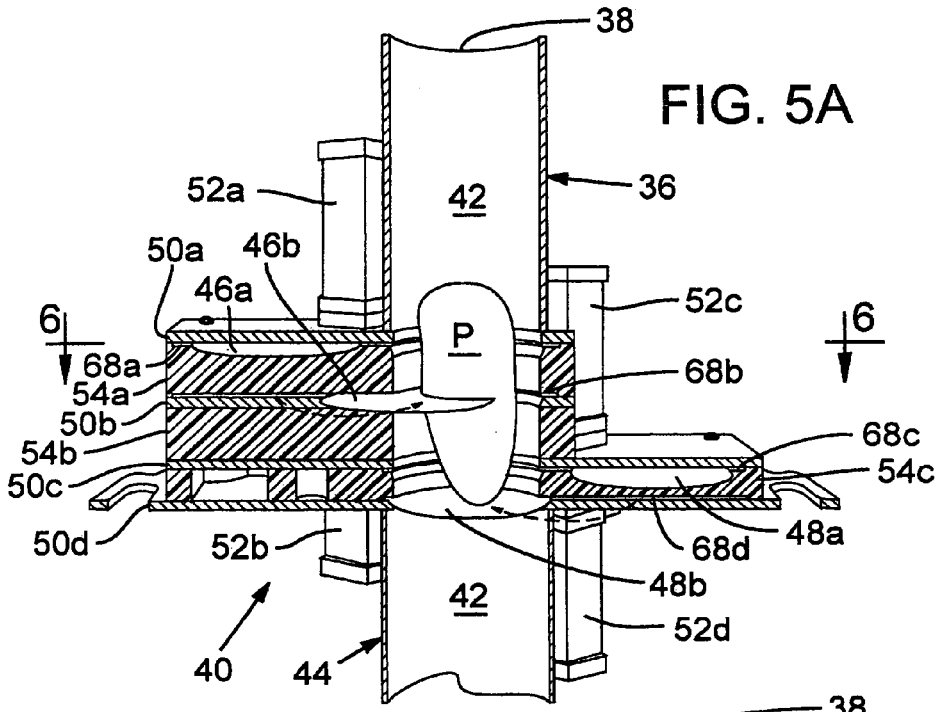
FIGS. 5A, 5B are partial vertical cross section views of the cutting assembly of FIG. 3.
Figure 5B:
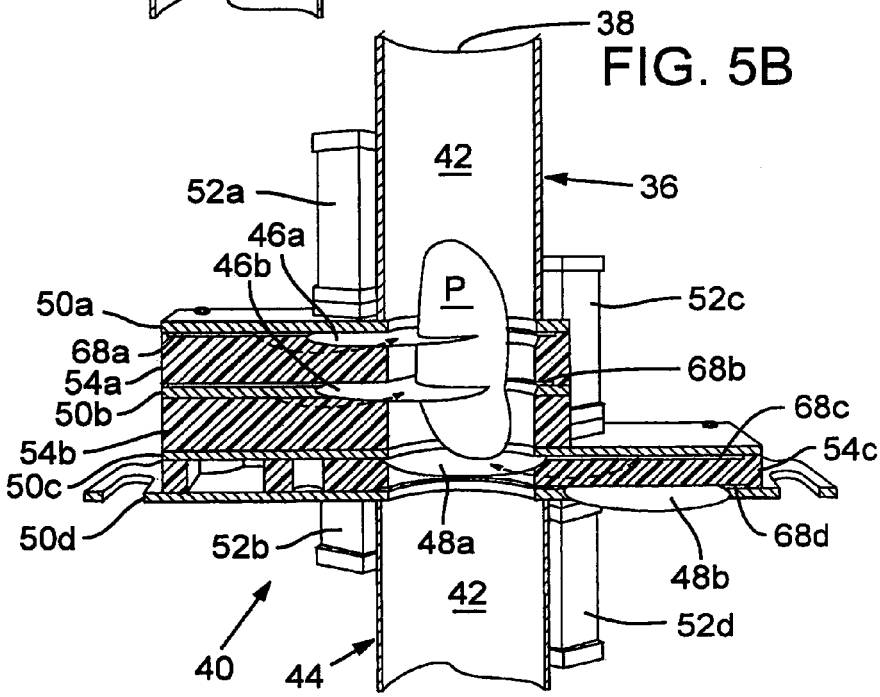
Figure 8A:
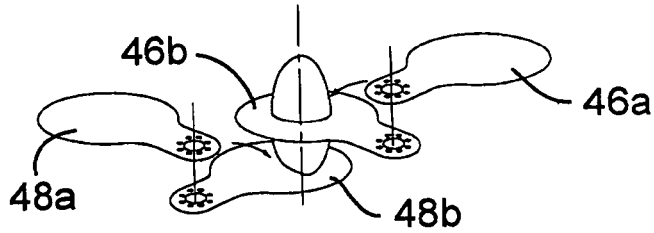
FIGS. 8A-F are schematic views illustrating various cutting operations of the cutting assembly.
Figure 8B:
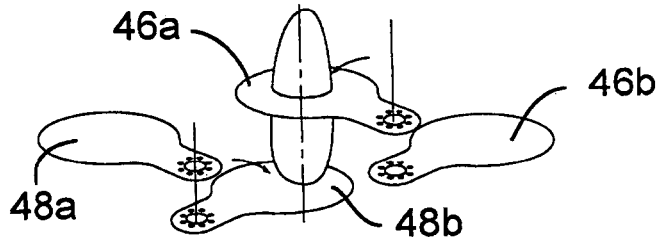
Figure 8C:
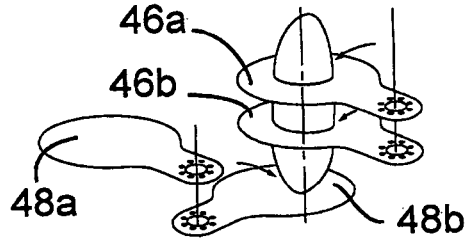
Figure 8D:
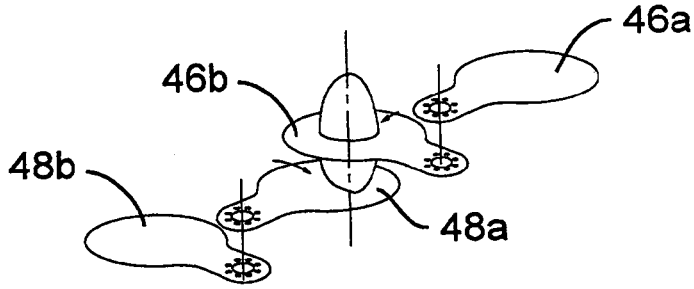
Figure 8E:
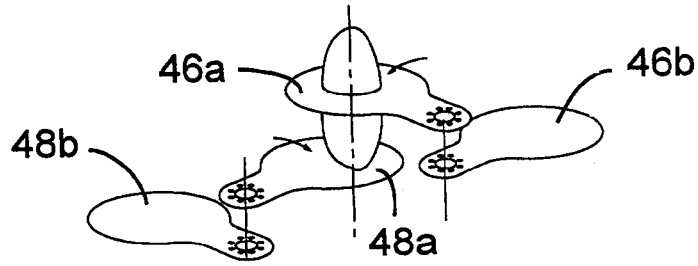
Figure 8F:
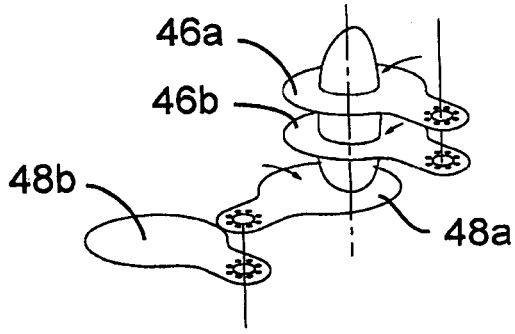

Before the potato reaches the cutting zone, the control system (described in greater detail below) actuates one of the two stops 48*a*, 48*b* to close the passageway, as illustrated in FIGS. 5A, 5B. FIG. 5A shows lower stop 48*b* in the extended position blocking the passageway, with upper stop 48*a* retracted in recess 68*c*. FIG. 5B shows upper stop 48*a* extended, with lower stop 48*b* retracted in recess 68*d*. After the slant conveyor deposits the potato into the mouth 38 of the passageway, the potato slides down the infeed tube 36 with its longitudinal axis parallel to the passageway until it encounters stop 48*b* (for example). At that point, the potato preferably is given a short amount of time to bounce and settle on the stop, before blade 46*a*, blade 46*b* or both are actuated to make one or more crosswise cuts in the potato. FIG. 5A shows blade 46*b* partially extending from recess 68*b* to slice the potato roughly into halves. FIG. 5B shows blades 46*a* and 46*b* partially extending from respective recesses 68*a*, 68*b* to slice the potato roughly into thirds.

FIG. 8 illustrates different ways in which the stops and blades may be actuated by the control system. In FIGS. 8A, 8B, and 8C, the lower stop plate 48*b* is actuated to provide a floor proximate to the exit tube. In FIGS. 8D, 8E, 8F, the upper stop plate 48*a* is actuated. FIGS. 8A and 8D show the lower blade 46*b* being actuated. In FIGS. 8B, 8E, upper blade 46*a* is actuated, and in FIGS. 8C, 8F, both blades are actuated. The system, described herein, provides different options as to where the crosswise cut is made in the potato relative to its downstream end. For example, the distance between the lowermost blade 46*b* and lowermost stop 48*b* is greater than the distance between the lowermost blade 46*b* and uppermost stop 48*a*, making it possible for the blade 46*b* to slice the potato transversely at different locations along the longitudinal axis of the potato. The number of crosswise cuts made to the potato also may be varied, an option especially attractive with longer potatoes or other relatively long food products. While the present invention has been described in the context of a system having two blades and two stops, it will be appreciated that the inventive features described herein may be applied to a system having one blade and one stop, a system having more than two stops and more than two blades, or a system having some combination thereof. For example, additional blade(s), additional stop(s) or both may be added, perhaps spaced more closely together, if the goal is to slice potatoes or other food products into fourths, fifths, etc.

The following is an exemplary cut table which illustrates one method for slicing potatoes into proportional length pieces, wherein $F_1$ is the upper stop, $F_2$ is the lower stop, $K_1$ is the lower blade, $K_2$ represents the upper blade, $F_1$ and $F_2$ are spaced 1-½ inches apart, $F_1$ and $K_1$ are spaced 3-¼ inches apart, $K_1$ and $K_2$ are spaced 3-¼ inches apart, the first piece represents the lowermost cut section of the potato, the second piece represents the cut section adjacent the first piece and the third piece (where applicable) represents the uppermost cut section of the potato:

Cut Table

| Food product Length (Inches) | 1st Piece (Inches) | 2nd Piece (Inches) | 3rd Piece (Inches) | Actuated |
|---|---|---|---|---|
| 6 | 3¼ | 2¾ | | $F_1$, $K_1$ |
| 7 | 3¼ | 3¾ | | $F_1$, $K_1$ |
| 8 | 4½ | 3½ | | $F_2$, $K_1$ |
| 9 | 4½ | 4½ | | $F_2$, $K_1$ |
| 10 | 3¼ | 3¼ | 3½ | $F_1$, $K_1$, $K_2$ |
| 10 (opt.) | 4½ | 5½ | | $F_2$, $K_1$ |
| 11 | 3¼ | 3¼ | 4½ | $F_1$, $K_1$, $K_2$ |
| 11 (opt.) | 4½ | 6½ | | $F_2$, $K_1$ |
| 12 | 4½ | 3¼ | 4¼ | $F_2$, $K_1$, $K_2$ |
| 12 (opt.) | 3¼ | 3¼ | 5½ | $F_1$, $K_1$, $K_2$ |
| 13 | 4½ | 3¼ | 5¼ | $F_2$, $K_1$, $K_2$ |
| 13 (opt.) | 3¼ | 3¼ | 6½ | $F_1$, $K_1$, $K_2$ |
| 14 | 4½ | 3¼ | 6¼ | $F_2$, $K_1$, $K_2$ |

By way of example, the table illustrates that a potato eleven inches long may be cut into three pieces of 3-¼ inches, 3-¼ inches and 4-½ inches or, alternatively, two pieces of 4-½ inches and 6-½ inches, depending on which stops and blades are actuated. A 12 inch food product may be cut into three pieces of 4-½, 3-¼ and 4-¼ inches or, alternatively, 3-¼, 3-¼ and 5-½ inches, depending on which stop is actuated. It will be appreciated that the illustrated cut options shown can be varied by changing the spacing between the blades and stops and/or the number of blades or stops available to be actuated. Whatever cut profile is selected by the processor, the present invention provides a highly accurate and precise cutting action. The potato is stationary during the cutting action. The blades are not part of a timing cycle designed to hit a moving target.

Once the cutting step is complete and the stop and blade(s) are retracted, the cut potato pieces drop away from the cutting zone, pass through the exit tube 44, and are deposited onto the outfeed conveyor 20 (FIG. 1).

The control system will now be described. The control system preferably is a conventional programmable logic controller, such as the Flexlogix model, made by Allan Bradley. The control system is electrically coupled to the sensors 33*a, b, c* and 34*a, b, c* and a multiplexed amplifier (not shown). The sensors sense the length of time any one of the three sets of transmitting and receiving sensors are blocked by a passing potato. The sensors detect the time it takes for each potato to pass through the vertical crosswise plane in which the sensors lie. From this elapsed time data and known speed of the slant conveyor, as programmed into the controller's database, the controller automatically applies an algorithm to calculate the length of the potato, compares the potato length to a database containing the cut table data above, and selects the stop and blade combination to be actuated.

For example, if the elapsed "passing" time is 0.5 second and the conveyor is traveling at a speed of 12 inches per second, the controller calculates that length of the potato as the product of the elapsed time and conveyor speed (or 6 inches). Once the trailing edge of the potato passes the sensors, the controller 22 initiates a timing sequence. In this example, the controller initially transmits an electrical signal to actuate the upper stop 48*a* ($F_1$) and, after a time delay, the lower blade 40*b* ($K_1$) in accordance with the exemplary logic embodied in the cut table above.

As another example, if the potato has a length greater than or equal to 9 inches but less than 10 inches, the controller signals the lower stop lower 48*b* ($F_2$) and lower blade 46*b* ($K_1$) for actuation, in accordance with the programmed logic set forth in the cut table above. For those potato lengths where two cut options are feasible, the controller automatically selects the option preselected by the operator. Referring again to the cut table above, for potatoes having a length at least ten inches and less than eleven inches the operator may select one of two preprogrammed options, one in which the lower stop 48*b* ($F_2$) and lower blade 46*b* ($K_1$) are actuated and another in which the upper stop 48*a* ($F_1$) and both blades ($K_1$ and $K_2$) are actuated. The controller also can be programmed to allow short potatoes, less than 6 inches, for example, to pass through the cutting assembly without being cut or delayed.

Once the controller selects the appropriate stop/blade combination for actuation, the controller immediately sends an electrical signal to actuate the pneumatic actuator for either stop 48*a* or 48*b*. Pressurized air is supplied to the pneumatic actuator to rotate the actuator shaft and stop, closing the passage 42 before the potato reaches the cutting zone. The potato slides down the infeed tube 36, bounces when it contacts the stop, and then after a short time settles on the stop. As part of the programmed timing sequence the controller actuates the designated blade(s) a set time after the potato clears the sensors, the blade actuation time being sufficient to allow the stop to move to its extended position and the potato to settle on the stop with its leading edge resting on the stop. As each actuated blade is extended by the pneumatic actuator, the potato is cut crosswise into two or three pieces, depending on the number of blades actuated. Later in the timing sequence, after the blade has extended fully, the controller signals the appropriate pneumatic actuators to retract each actuated blade and stop. The programmed timing sequence also allows time for the cut pieces to exit the cutting assembly. Notably, the entire timing sequence may take less than two seconds.

In those instances where a second potato passes the sensors prematurely, before the timing sequence for the preceding potato has timed out, the controller is programmed to recognize the timing issue and allow the second potato to pass through the cutting zone without being cut. This "pass through" will continue until the controller determines there is sufficient time to cut the next potato.

The controller 22 can be programmed to operate independently plural side-by-side cutting lanes in which separate slant conveyors are fed by the shaker conveyor and in turn feed separate cutting assemblies, as shown in FIG. 1. In this way, a larger number of potatoes can be processed and, if necessary, diverted away from any lanes that are not operational due to maintenance problems or otherwise.

As shown in FIG. 9, in a multiple cutting assembly system, each cutting assembly 18 preferably is freely supported by a pair of support plates 70*a, b* on either side of the cutting assembly. The support plates for each cutting assembly are mounted to common support shafts 72, 76 which in turn are supported by a frame 74. Each cutting assembly preferably rests freely on a plurality of adjustable rollers or catch members 77 (some of which are hidden in FIG. 9) that support the underside and back of the cutting assembly. The angle of the support plates 70*a*, 70*b* and hence angle of incline of the cutting assemblies can be adjusted by fastening the catch members to different locations on the support plates using a plurality of mounting openings in the support plates. In this way, the downward slope of the cutting assemblies can be made more or less steep.

Having described and illustrated the principles of our invention with reference to a preferred embodiment and several variations thereof, it should be apparent that the invention can be modified in arrangement and detail without departing from its principles. Accordingly, we claim all such modifications that come within the true spirit and scope of the following claims:

We claim:

1. An apparatus for slicing food products into pieces comprising:

a housing defining a cutting station and a passageway;

a stop member actuatable between a stop position in which the stop member obstructs the passageway and a retracted position in which the food product is free to pass through the passageway, the stop member serving to temporarily stop movement of the food product through the passageway and retain the food product in a substantially stationary position during cutting;

at least one cutting blade actuatable between a retracted position outside the passageway and an extended position in which the blade substantially transversely spans the passageway;

a support member to support each blade at a predetermined longitudinal distance from the stop member;

an actuation system for actuating the stop member, actuating the cutting blade after a time delay to slice the food product into pieces as it rests against the stop member, and then after a further time delay actuating the stop member and cutting blade to retract; and the stop member and at least one cutting blade further comprising plural stop members and plural cutting blades supported by the housing at spaced apart longitudinal locations relative to the passageway, each being retained in a respective recess defined by the housing and each being independently actuatable.

2. The apparatus of claim 1 wherein each stop member and cutting blade is actuatable by a separate actuating device.

3. The apparatus of claim 2 wherein each actuating device is a rotary pneumatic actuator.

4. The apparatus of claim 2 wherein the housing includes support plates to support each stop member and cutting blade associated with each stop member and cutting blade, and spacer members located between adjacent support plates to provide a longitudinal spacing therebetween.

5. An apparatus for slicing food products into pieces, comprising:

a housing defining a passageway through which the food products pass one at a time;

a plurality of stop members and cutting blades, each supported by the housing for movement between a retracted position outside the passageway and an extended position extending substantially transversely across the passageway;

an independently operable actuating device associated with each stop member and cutting blade;

each stop member being operable, when extended, to hold the food product in place in the passageway, each cutting blade being operable, during extension, to slice the food product into pieces;

the stop members and cutting blades being selectively actuatable to vary the relative location of the food product in the passageway during cutting, vary the relative longitudinal location in the passageway where the cutting blade engages the food product during cutting and vary the number of cutting blades actuated to slice the food product.

6. The apparatus of claim 5 wherein the passageway has a longitudinal axis and each blade is actuatable to extend substantially transversely across the passageway.

7. The apparatus of claim 5 wherein each cutting blade and stop member includes a substantially circular portion and an extension portion extending from the circular portion, the extension portion being pivotally mounted to the housing.

* * * * *